US005599024A

United States Patent [19]

Acuff et al.

[11] Patent Number: 5,599,024

[45] Date of Patent: Feb. 4, 1997

[54] PORTABLE SOCCER GOAL

[76] Inventors: Burnis S. Acuff, 9 Monte Sano Dr., Charleston, S.C. 29406; Royce B. Charpia, 119 Vision La., Summerville, S.C. 29483

[21] Appl. No.: 551,118

[22] Filed: Oct. 31, 1995

[51] Int. Cl.[6] ..... A63B 63/00

[52] U.S. Cl. ..... 473/478; 273/400

[58] Field of Search ..... 273/400, 411, 273/127 B, 398, 399

[56] References Cited

U.S. PATENT DOCUMENTS

| | | | |
|---|---|---|---|
| 4,169,598 | 10/1979 | Taylor | 273/400 |
| 5,080,375 | 1/1992 | Moosavi | 273/400 |
| 5,301,955 | 4/1994 | Fedullo | 273/400 |
| 5,372,368 | 12/1994 | Pavonetti | 273/127 B |
| 5,421,586 | 6/1995 | Amram et al. | 273/400 |
| 5,476,266 | 12/1995 | Caruso | 273/127 B |

FOREIGN PATENT DOCUMENTS

| | | | |
|---|---|---|---|
| 2847701 | 5/1980 | Germany | 273/400 |
| 242175 | 1/1987 | Germany | 273/411 |

*Primary Examiner*—Mark S. Graham
*Attorney, Agent, or Firm*— Dallis Law Firm, P.A.

[57] ABSTRACT

A portable soccer goal easily assembled and disassembled that is made of sturdy materials with a crossbar supported by two end posts. The crossbar is connected to each end post by a steel crossbar connector. Each end post is in turn held in a vertical position by a support base consisting of a horizontal leg connected to the end post by a steel elbow connector. The portable soccer goal is secured in position by a stake driven into the ground surface through a pre-drilled boring located in the rear of the horizontal leg. Additional stability is provided by an insertion rod connected to the bottom of the steel elbow end post connector which projects into the ground surface.

5 Claims, 4 Drawing Sheets

PORTABLE SOCCER GOAL

BACKGROUND OF THE INVENTION

1. Field of the Invention

The present invention relates to goals used for the sport of soccer and, more particularly, to a type of soccer goal that is easily assembled and disassembled for portability purposes considering elements of durability and economy of construction.

2. Description of the Related Art

The game of soccer is perhaps one of the oldest team sports still actively played. Soccer has long been popularized in Europe and in Latin America. Although not as popular in the United States, it continues to attract a growing audience. Most soccer enthusiasts, however, find it difficult to secure playing fields strictly dedicated to the game of soccer because of the domination of other field sports such as American football and baseball. As a result, these same enthusiasts must often use any available open field to engage in their sport. It is out of this necessity that the demand for simple and sturdy portable soccer goals evolved.

The standard, regulation size goal construction requires, at a minimum, a crossbar 24 feet across, supported on both ends by uprights 8 feet high. The means by which the two uprights and crossbar are secured to each other and to the ground vary widely for both permanent and portable goals. The existing prior art in the field of portable goals includes soccer goals that can be assembled or disassembled through the segmentation of the principle members of the goal. Variations exist for materials used and means for attaching and detaching the various segments.

Pennell, U.S. Pat. No. 4,127,272, describes a collapsible goal with the crossbar member connected by two triangular end pieces. The triangular end pieces are constructed of hinged legs and are detachable from the crossbar.

Caruso et al., U.S. Pat. No. 4,407,507, reveals a portable soccer goal with two end supports each comprising a vertical, stationary post and a hinged leg support, both ends of which are secured to a flat face plate.

Pardi et al., U.S. Pat. No. 5,273,292, demonstrates a regulation size portable soccer goal constructed of two U-shaped sections hinged together at the open ends of the U-shapes and supported in a perpendicular position by two backstays.

Terris, U.S. Pat. No. 5,186,469, describes a collapsible soccer goal having a U-shaped upright end that collapses onto a U-shaped ground level end. Both U-shaped members are hinged together at the open ends of the "U" and are supported in an upright and open position by hinged back braces.

All of the above cited prior art incorporate either triangular shaped support ends or the coupling of two U-shaped members fixed perpendicular to each other when in the upright position. It is the objective of the present invention to provide a simple and sturdy portable soccer goal. Such a goal would be easy to assemble and made of rugged materials making it functionally comparable to a permanent goal.

SUMMARY OF TEE INVENTION

It is therefore an objective of this invention to provide a simple and sturdy soccer goal that is portable.

It is further an object of this invention to provide a portable soccer goal that is easy to assemble with minimal use of fasteners.

It is still further an objective of this invention to provide a soccer goal made of rugged materials that make it of comparable durability to that of a permanent type goal.

These as well as other objects are accomplished by an aluminum crossbar 24 feet in length supported on both ends by two solid wooden end posts 8 feet in height. The wooden end posts are fixed in a vertical position by means of a hollow steel elbow supported on the ground by a wooden base support leg extending horizontally from the steel elbow sleeve. The wooden base support is secured in position by a T-stake driven into the ground through a boring drilled into the ends of the wooden base support. The soccer goal net is fastened to each goal support element by means of a simple weaving action wherein the crossbar, end posts and base supports are woven through the edges of the net. The portion of the net laying at ground level between the end supports is secured to the ground by means of small stakes.

BRIEF DESCRIPTION OF THE DRAWINGS

A preferred embodiment of the present invention is described herein with reference to the drawings wherein.

DETAILED DESCRIPTION OF THE PREFERRED EMBODIMENT

Figure 1:
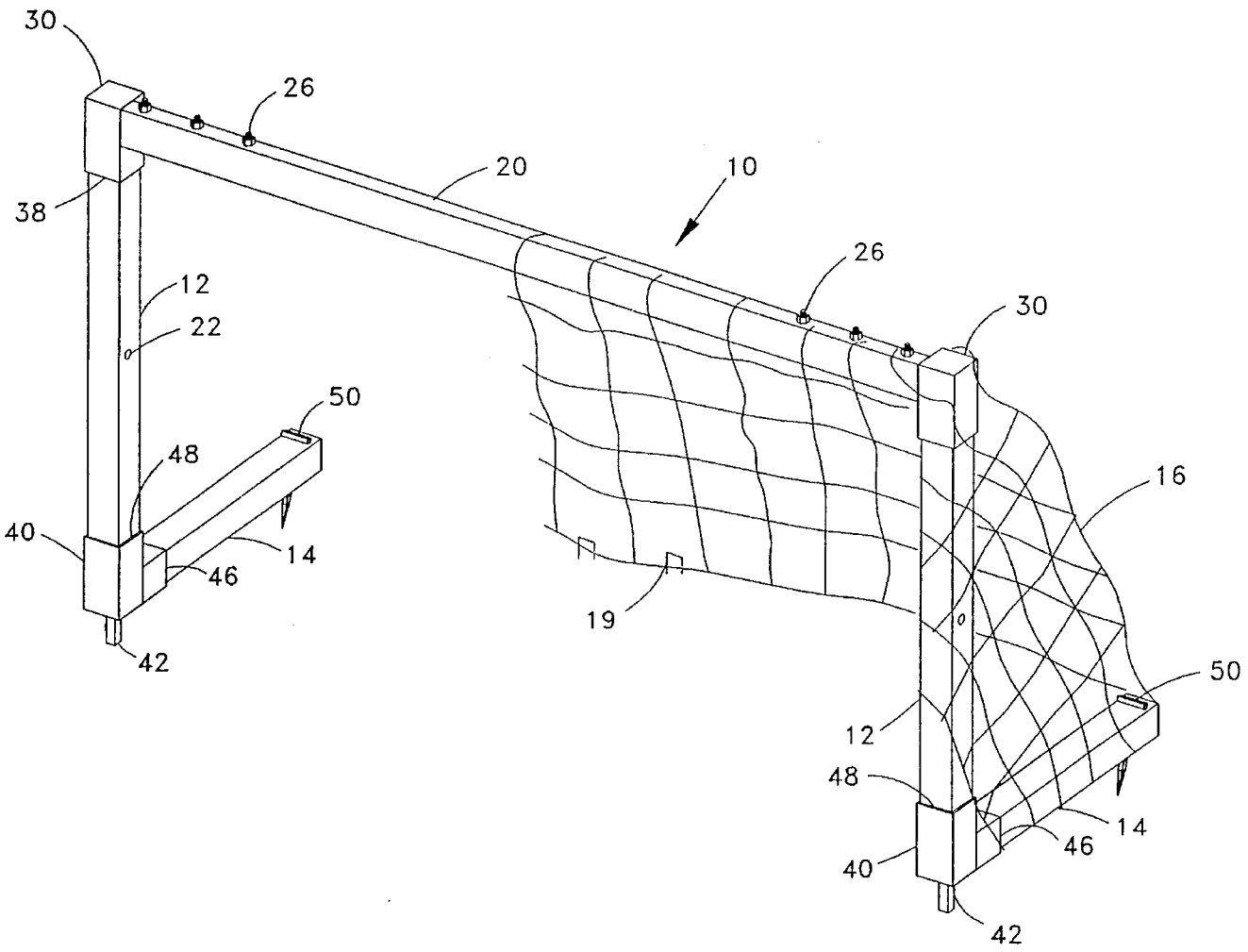
FIG. 1 of the drawings illustrates a perspective view of the portable soccer goal showing all fundamental elements of the invention.
Figure 2:
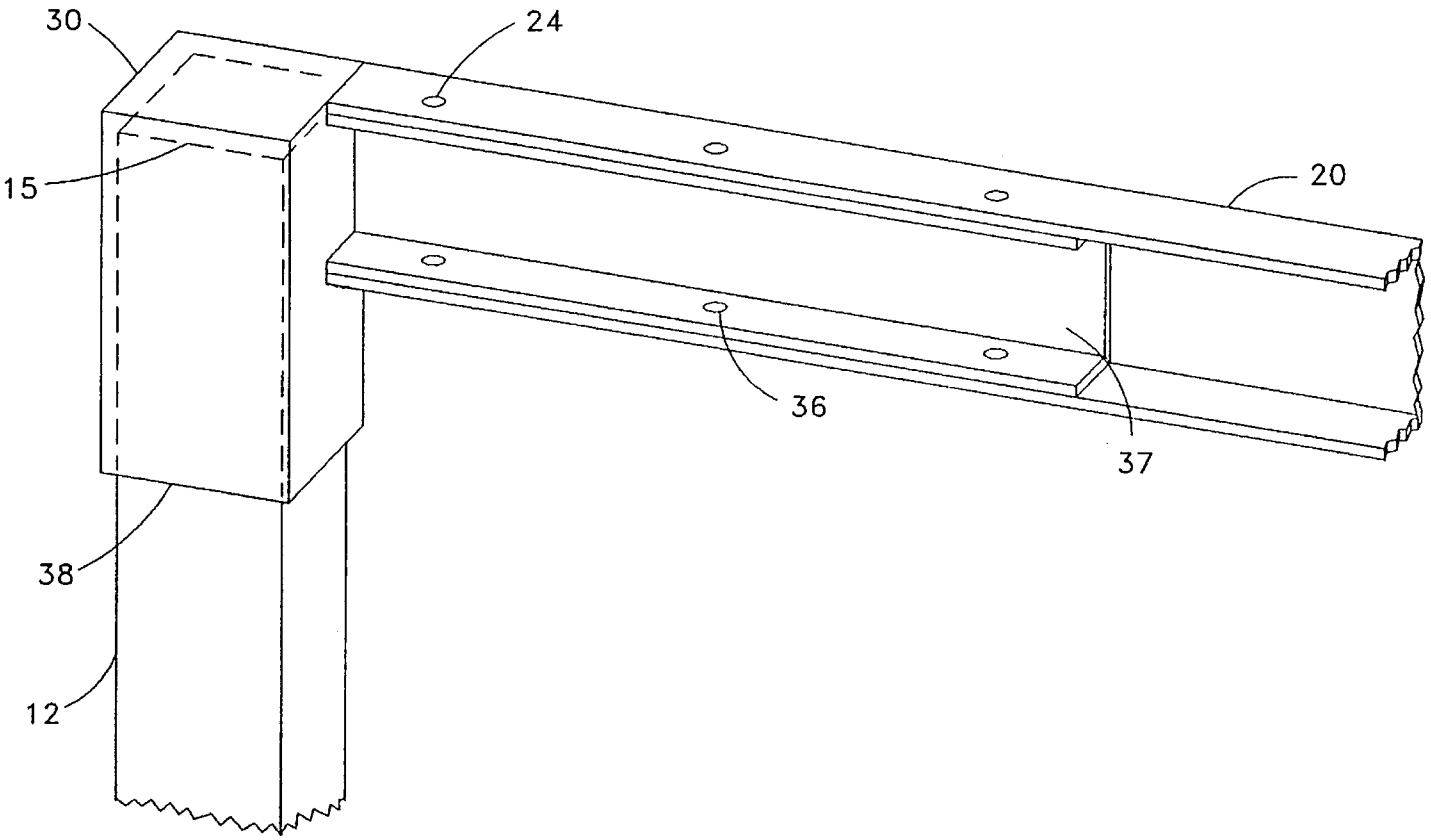
FIG. 2 of the drawings illustrates a perspective rear view of the upper corner of the portable soccer goal revealing the support mechanism for the crossbar.
Figure 2A:
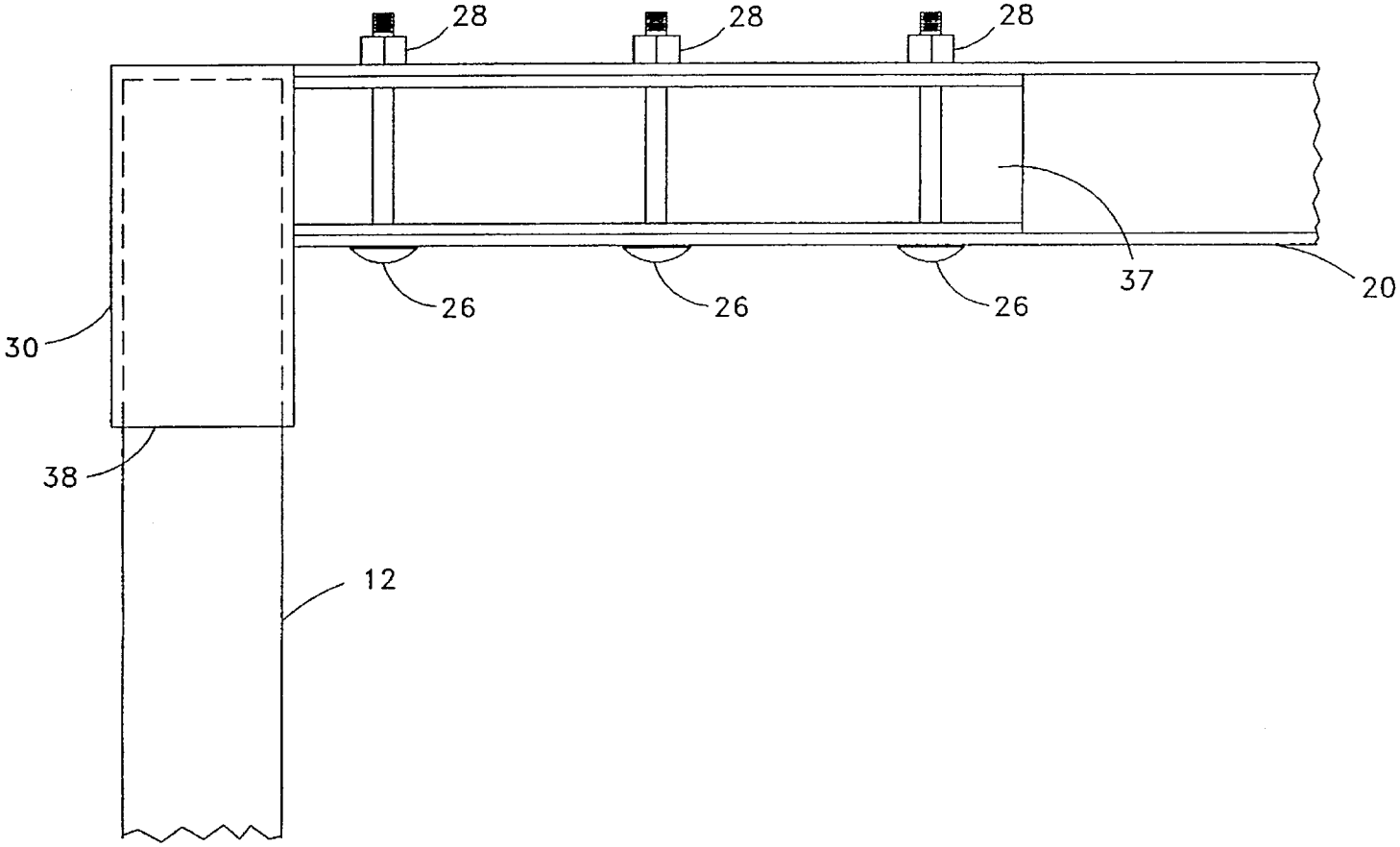
FIG. 2*a* of the drawings illustrates a rear view of the same upper corner of the portable soccer goal as depicted in FIG. 2 revealing the bolting means of the crossbar to the cross bar connector.
Figure 3:
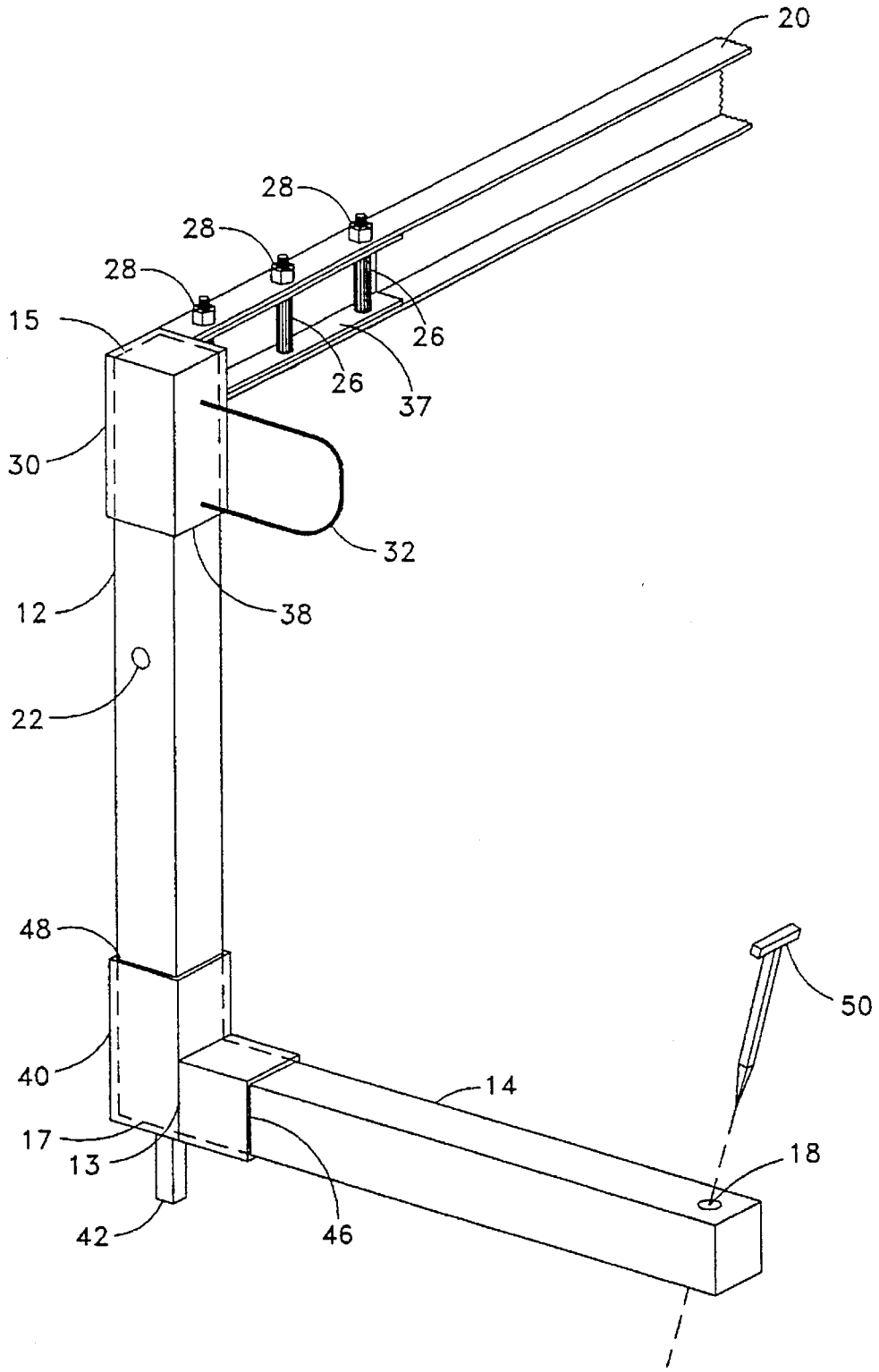
FIG. 3 of the drawings illustrates a perspective rear view of one side of the portable soccer goal showing the base support and base support elbow.

Referring to the drawings by numerals of reference, there is shown in FIGS. 1–3 a preferred portable soccer goal (10), a crossbar (20), two end posts (12), two base support legs (14), and a net (16). The crossbar (20) is supported by two end posts (12) by means of crossbar connectors (30). Both end posts (12) are supported in the vertical position by means of a base support elbow (40) in the form of a right-angle elbow.

The end post head (15) inserts through the crossbar connector sleeve (38) while the crossbar (20) is secured to the crossbar connector extension (37). The fastening means of the crossbar (20) to the crossbar connector extension (37) is achieved by a plurality of bolts (26) and nuts (28) placed in the crossbar borings (24) and the crossbar connector extension borings (36). The end post foot (17) inserts into the base support elbow vertical sleeve (48) while the base support anterior (13) inserts into the base support elbow horizontal sleeve (46). The two end posts (12) each have a dowel boring (22) for the insertion of a dowel for easier removal of the two end posts (12) from the base support elbow (40).

The portable soccer goal (10) is secured to the ground surface by means of an insertion rod (42) secured to the base support elbow (40) opposite the base support elbow vertical sleeve (48) and a T-stake (50) driven through the base support end boring (18). The soccer goal net (16) is secured to each leg member of the portable soccer goal (10) by simply weaving the separate leg members through the edges of the net (16). The rear portion of the net (16) is secured to the ground surface by means of net stakes (19). A net extension bar (32) extends outward from the crossbar connectors (30) to provide horizontal support to the net (16).

A preferred embodiment of the present invention is described herein. It is to be understood, of course, that changes and modifications may be made in the embodiment without departing from the true scope and spirit of the present invention as defined by the appending claims.

That which is claimed is:

1. A portable soccer goal comprising, in combination:

a. a first and second base support leg, each having an anterior end and a posterior end, said first and second base support legs resting on a ground surface;

b. a first and second base support elbow, each said elbow having a vertical and horizontal sleeve at 90 degree configurations, said first and second anterior ends of said first and second base support legs inserting into said first and second horizontal sleeve, respectively, of said first and second base support elbows;

c. a first and second end post, each said end post having an end post head and end post foot, said first and second end post foot inserting into said first and second vertical sleeve, respectively, said first end post and said first base support leg having 90 degree configurations and said second end post and said second base support leg having 90 degree configurations;

d. a first and second crossbar connector, each said crossbar connector having a crossbar connector sleeve and crossbar connector extension, said first and second end post head inserting into said first and second crossbar connector sleeves, respectively;

e. a crossbar with a first and second end and interior and exterior face, said first and second crossbar connector extension fastening to said first and second crossbar end, respectively, said first and second end post forming a 90 degree configuration with said first and second crossbar end, said crossbar and said first and second crossbar connector extensions being channel shaped;

f. a first and second fastener means for securing said first and second base support leg posterior ends to said ground surface;

g. a first and second insertion rod connected to said first and second base support elbows, respectively, said first and second insertion rods being connected opposite said first and second base support vertical sleeves as a means for securing said first and second base support elbows to said ground surface;

h. a net having a ground edge and secured edge, said first and second base support legs, base support elbows, end posts and said crossbar being woven into said net secured edge;

i. A plurality of net stakes designed to secure said net ground edge to a ground surface between said first base support leg and said second base support legs.

2. A portable soccer goal as claimed in claim 1 wherein said first and second crossbar connector extensions have an extension interior face and extension exterior face such that said first and second crossbar connector extensions are of such shape and size to fit snugly against said interior face of said crossbar connector resulting in a contact surface between said interior face of said crossbar and said extension exterior face of said first and second crossbar connector extensions.

3. A portable soccer goal as claimed in claim 2 wherein a number of hole borings penetrate through said exterior and interior face of said crossbar and said extension exterior and interior face of said first and second crossbar connector extension extensions such that threaded bolts insert through said hole borings as a means for securing said first and second crossbar extensions to said crossbar.

4. A portable soccer goal as claimed in claim 1 wherein a first and second net extension bar extends horizontally from the first and second crossbar connector in a direction over said first and second base support legs, respectively, for the purpose of supporting said net, said first and second net extension bars comprising a horizontally looping bar having a top and bottom crossbar connector end connecting to said first and second crossbar connectors, respectively, said first and second net extension bars extending horizontal in the direction of said net a distance sufficient to minimize said net from draping over a back side of said crossbar.

5. A portable soccer goal comprising, in combination:

a. a first and second base support leg, each having an anterior end and a posterior end, said first and second base support legs resting on a ground surface;

b. a first and second base support elbow, each said elbow having a vertical and horizontal sleeve at 90 degree configurations, said first and second anterior ends of said first and second base support legs inserting into said first and second horizontal sleeve, respectively, of said first and second base support elbows;

c. a first and second end post, each said end post having an end post head and end post foot, said first and second end post foot inserting into said first and second vertical sleeve, respectively, said first end post, and said first base support leg having 90 degree configurations and said second end post and said second base support leg having 90 degree configurations;

d. a first and second crossbar connector, each said crossbar connector having a crossbar connector sleeve and channel shaped crossbar connector extension, wherein said first and second end post head insert into said first and second crossbar connector sleeves, respectively;

e. a channel shaped crossbar with a first and second end and interior and exterior face, said first and second crossbar connector extension fastening to said first and second crossbar end, respectively, said first and second end post forming a 90 degree configuration with said first and second crossbar end;

f. a first and second fastener means for securing said first and second base support leg posterior ends to said ground surface;

g. a first and second insertion rod connected to said first and second base support elbows, respectively, said first and second insertion rods being connected opposite said first and second base support vertical sleeves as a means for securing said first and second base support elbows to said ground surface;

h. a net having a ground edge and secured edge, said first and second base support legs, base support elbows, end posts and said crossbar being woven into said net secured edge;

i. A plurality of net stakes designed to secure said net ground edge to a ground surface between said first base support leg and said second base support leg;

j. an extension interior face and extension exterior face said first and second crossbar connector extensions being of such shape and size to fit snugly against said interior face of said crossbar connector resulting in a contact surface between said interior face of said crossbar and said extension exterior face of said first and second crossbar connector extensions;

k. a number of hole borings that penetrate through said exterior and interior face of said crossbar and said extension exterior and interior face of said first and second crossbar connector extensions wherein threaded bolts insert through said hole borings as a means for securing said first and second crossbar connector extensions to said crossbar;

l. a fastener means for securing said first and second base support leg posteriors to said ground surface comprising T-stakes;

m. a first and second net extension bar extending horizontally from the first and second crossbar connector in a direction over said first and second base support legs, respectively, for the purpose of supporting said net;

n. a first and second dowel boring for the purpose of facilitating removal of said first and second end posts from said first and second base support connectors by inserting a first and second dowel inside said first and second dowel boring and using said first and second dowel as means for gripping.

* * * * *